US005579017A

United States Patent [19]

Smith

[11] Patent Number: 5,579,017

[45] Date of Patent: Nov. 26, 1996

[54] SMITHDOM IMPROVED MULTIBAND ANTENNA AND METHOD

[76] Inventor: Ralph L. Smith, 255 N. Old Manor, Wichita, Kans. 67208

[21] Appl. No.: 398,800

[22] Filed: Mar. 6, 1995

[51] Int. Cl.[6] ..... H01Q 11/12

[52] U.S. Cl. ..... 343/722; 343/749; 343/752

[58] Field of Search ..... 343/722, 749, 343/751, 752, 820, 821, 822, 850, 856, 857, 860; H01Q 11/12

[56] References Cited

U.S. PATENT DOCUMENTS

| | | | |
|---|---|---|---|
| 2,229,865 | 1/1941 | Morgan | 343/722 |
| 2,282,292 | 5/1942 | Amy et al. | 343/722 |
| 2,989,626 | 6/1961 | Welch | 343/722 |

OTHER PUBLICATIONS

Minarik, "Adding 21MC To The Off–Center–Fed Antenna", Radio & TV News, Jun. 1958, p. 48.

DeMaw, "Lightweight Trap Antennas–Some Thoughts", ARRL Senior Technical Editor, Jun. 1983, pp. 15–18.

*Primary Examiner*—Hoanganh T. Le

*Attorney, Agent, or Firm*—John W. Carpenter

[57] ABSTRACT

A broadband off-center fed dipole antenna capable of resonating at multiple frequencies with a near integer relationship between fundamental and harmonic frequencies and with standing wave ratio of less than or equal to 1.5:1 at desired frequencies without the need of an antenna tuning device. One preferred embodiment of the antenna comprises a first radiating section having an inner line electrically coupled to a balun transformer and a trap and an outer line electrically connected to the trap and an insulator. A second radiating section is connected to the balun transformer and has another insulator secured to its other end.

10 Claims, 5 Drawing Sheets

SMITHDOM IMPROVED MULTIBAND ANTENNA AND METHOD

FIELD OF THE INVENTION

The present invention relates broadly to antennas. More specifically, the present invention relates to a harmonic antenna for use with radio transmitters and receivers.

BACKGROUND OF THE INVENTION

Antennas are old and well-known devices in the art that have seen a wide array of manifestations. Antennas may be optimized for use on a single radio frequency, designed with several conductors optimized for multiple frequencies, or designed to harmonically resonate at multiple frequencies. Harmonically operated antennas are somewhat compromised in that not all harmonics (especially the fundamental) are related by an integer (i.e. "perfect" octave or octaves) due to end effect. Thus, expensive antenna tuning devices are often additionally required to provide a low standing wave ratio to the transmitter on some frequencies. A more reasonable approach is an inexpensive antenna that is capable of resonating on multiple frequencies, and which utilizes traps to electrically lengthen or shorten the antenna and selectively alter the fundamental frequency and the harmonic frequencies.

A patentability investigation was conducted and the following U.S. Pat. Nos. were found: U.S. Pat. No. 2,967,300 to Haughawout; U.S. Pat. No. 3,339,205 to Smitka; U.S. Pat. No. 4,062,017 to Thompson; and U.S. Pat. No. 4,423,423 to Bush.

The U.S. Pat. No. 2.967,300 to Haughawout teaches a multiple band antenna utilizing a half wave dipole radiator comprising two like sections, each including three coaxial or concentric elements of graduated length. Each of the sections includes telescoping tuning sleeves between two of the radiating elements. Parasitic elements, for increasing directivity, also include coaxial and parasitic elements.

The U.S. Pat. No. 3,339,205 to Smitka teaches an array of antennae in which the motion or resonance of an individual dipole is simulated by successive connection of the interconnected dipoles. The dipoles are of a length in which the natural wavelengths of the dipoles are far outside the operational frequency to minimize parasitic interaction of passive antennae. The array of dipoles are switched in and out of the antenna circuit by means of diodes and control pulses. This antenna is typically used in Doppler navigation systems for receiving.

The U.S. Pat. No. 4,062,017 to Thompson discloses a multiple frequency antenna formed of a plurality of conductors interconnected by coaxial cable and connected to a feedline or transmission line. This antenna uses several radiating elements in covering multiple bandwidths.

The U.S. Pat. No. 4,423,423 to Bush teaches a folded dipole antenna for use over a broad bandwidth which has a shortened overall length proportional to the operational bandwidth. The folded portions of the dipoles are set apart by spacer members.

None of the foregoing prior art U.S. Patents teach or suggest the particular apparatus or method for the antenna of the present invention. More particularly, none of the foregoing prior art teach or suggest the antenna of the present invention which is an inexpensive multiple frequency harmonic antenna that is capable of transmitting and receiving wide bandwidths with a low standing wave ratio. The antenna of the present invention can be used on most sets of harmonic frequencies and is an excellent candidate for use on Radio Amateur High Frequency Bands, or commercial and/or military operations especially when using frequency-hopping, band hopping and/or other spread-spectrum modulations.

SUMMARY OF THE INVENTION

The present invention broadly accomplishes its desired objects by providing an improved wide bandwidth antenna with multiple resonances for use with radio transmitters and receivers. The improved antenna is for use in the transmission and reception of radio frequency energy when employed over a broad bandwidth while maintaining a standing wave ratio of less than about 1.5:1 for most frequencies in the operational bandwidth without requiring the use of an antenna tuning means, and comprises a first radiating element having a pair of opposed ends and a first length and a second radiating element having a pair of opposed ends and a second length interconnected by a balun member which electrically interconnects one of the opposed ends of the first radiating element to one of the opposed ends of the second radiating element. Alternatively the first and second radiating elements are bound by an insulator at the excitation point for being connected to a feedline, in the case a balun is not desired or required. A first insulator member is secured to another of the opposed ends of the first radiating element and a second insulator member is secured to another of the opposed ends of the second radiating element. The improved antenna further has a capacitor (i.e., which may be comprised of a first trap member or parallel resonant circuit) electrically disposed in the first radiating element such that the first radiating element defines an outer radiating element electrically communicating with the first insulator member and the capacitor or first trap member and an inner radiating element electrically communicating with the balun member and the capacitor or first trap member. The improved antenna may additionally comprise a second trap member electrically disposed in the second radiating element such that the second radiating element comprises a second outer radiating element which electrically communicating with the second insulator member and the second trap member and a second inner radiating element electrically communicating with the balun member or, in the case a balun is not used, connected to the insulator at the excitation point and the second trap member. The improved antenna of the invention electrically shortens inversely to frequency, with the capacitor or the first trap member for compensating end effect of the antenna at its natural fundamental frequency and harmonic and frequencies thereof, and electrically lengthens with the inductor of the first trap member for resonating at sub-harmonic frequencies.

The present invention further broadly accomplishes its desired objects by providing a method for compensating end effect at a fundamental frequency while retaining broadband capabilities of an off-center fed dipole antenna (e.g. a Windom). The method comprises the steps of:

(a) providing an improved broadband off-center fed dipole antenna (e.g. a Windom) capable of transmitting radio waves (i.e. radio frequency energy) in the range of 10.0 KHz to 250.0 MHz, preferably in the range of 1.8 MHz to about 30.0 MHz, and having a fundamental frequency and at least one trap (i.e. a parallel resonant circuit) wired in series therewith;

(b) coupling the improved antenna to a radio frequency generator (e.g. a radio transmitter);

(c) radiating or transmitting radio waves (i.e. radio frequency energy) with the improved antenna; and (d) reducing end effect at the fundamental frequency of the improved antenna with the use of a trap (i.e. a parallel resonant circuit having a capacitor and an inductor in parallel).

The present invention further still accomplishes its desired objects by providing a method/apparatus for radiating or transmitting radio waves (i.e. radio frequency energy) in the range of from about 10.0 KHz to about 250 MHz, preferably in the range of 1.80 MHz to about 30 MHz, with an improved standing wave ratio with an off-center fed dipole antenna (e.g. a windom). The method comprises the steps of:

(a) providing an improved broadband off-center fed dipole antenna capable of radiating or transmitting radio waves (i.e. radio frequency energy) in a frequency in the range of 10.0 KHz to 250.0 MHz, preferably in the range of 1.80 MHz to about 30.0 MHz, having at least one trap member (i.e. a parallel resonant circuit or capacitor) wired in series therewith;

(b) coupling the improved antenna to a radio frequency generator capable of generating radio frequency energy in the range of 10.0 KHz to 250.0 MHz, preferably in the range of 1.80 MHz to about 30.0 MHz;

(c) generating radio frequency energy with the radio frequency generator and relaying the generated radio frequency to the improved antenna;

(e) radiating or transmitting radio waves with the improved antenna such that the radio frequency energy (i.e. antenna current) passes through the trap member to alter the fundamental frequency of the improved antenna.

The present invention further yet accomplishes its desired objects by providing a space limited antenna for use on 75/80, 40, 20, and 10 meter bands.

These, together with the various ancillary objects and features which will become apparent to those skilled in the art as the following description proceeds, are attained by this novel apparatus and method, a preferred embodiment thereof shown with reference to the accompanying drawings, by way of example only, wherein:

DETAILED DESCRIPTION OF THE INVENTION

Figure 2:
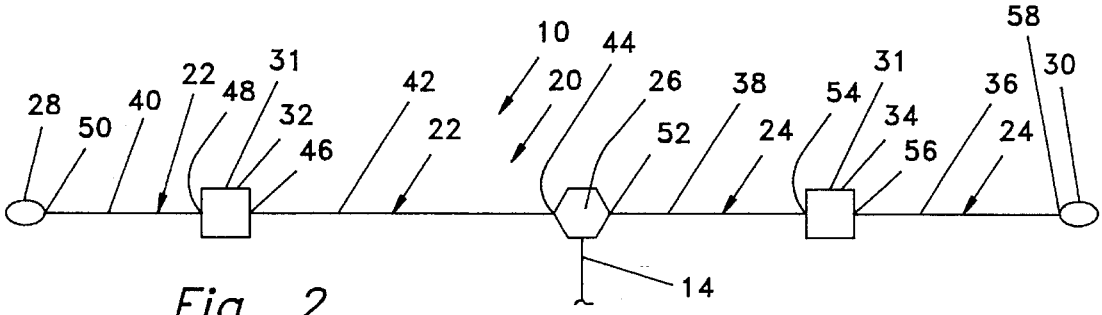
FIG. 2 is a diagram of one embodiment of the antenna of the present invention.
Figure 3:
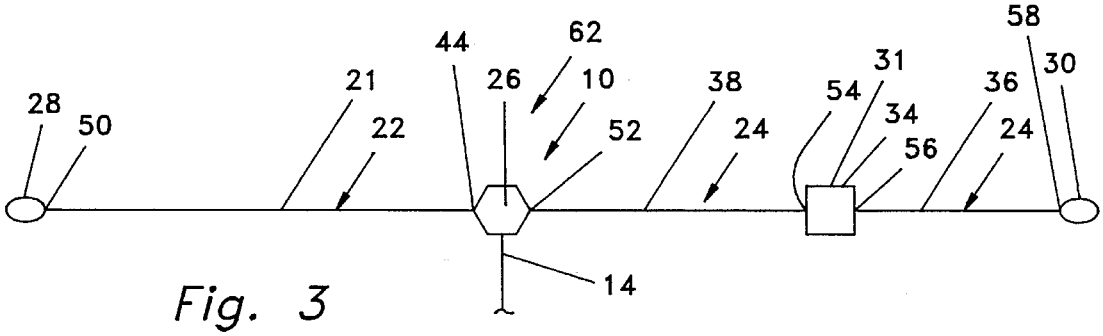
FIG. 3 is a diagram of another embodiment of the antenna of the present invention.
Figure 4:
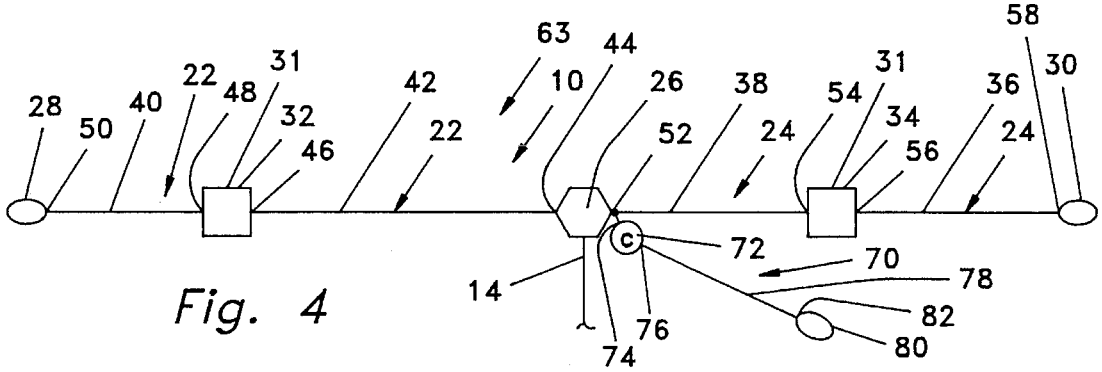
FIG. 4 is a diagram of another embodiment of the antenna of the present invention.
Figure 5:
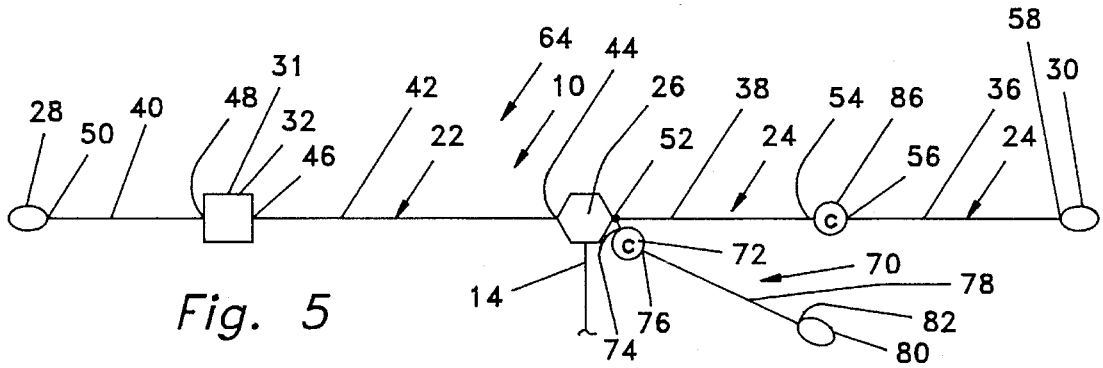
FIG. 5 is a diagram of another embodiment of the antenna of the present invention.

Turning now to the drawings wherein like parts of the invention are identified by similar reference numerals, there is seen in FIG. 2 a diagram of one embodiment of the "Smithdom" improved broadband antenna of the invention, generally illustrated as 10. FIGS. 3–5 show additional embodiments of the present invention, also generally illustrated as 10, as will be discussed hereafter.

Figure 1:
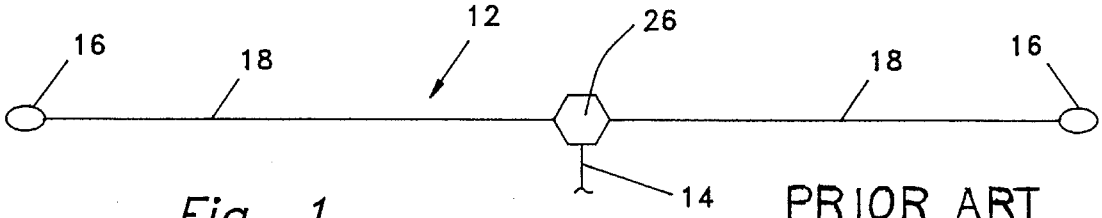
Fig. 1 PRIOR ART
FIG. 1 is a diagram of a prior art Windom dipole antenna.

FIG. 1 is a diagram of a prior art off-center fed half-wavelength dipole antenna, sometimes known to those artisans skilled in the art as a Windom dipole, and generally illustrated as 12. A typical embodiment of the Windom antenna 12, as shown in FIG. 1, has a length of about 136 feet and couples to a transmission line 14 in an off-center manner (i.e. the connection does not bisect the antenna 12 into equal halves of radiating elements, to be identified as 18 below; rather the connection bisects the antenna 12 into uneven lengths of radiating elements identified as 18 below) at the excitation point through an insulated common connection point and/or an antenna matching means such as, by way of example only, a balun transformer 26. Usually the connection of the antenna 12 to the transmission line occurs at a point along the antenna corresponding to about ⅓ of the length of the antenna 12, such that the connection is spaced generally ⅓ of the length of the antenna 12 from one end and spaced generally ⅔ of the length of the antenna from another end. A pair of insulators (or terminators) 16—16 is secured to opposed ends of radiating elements 18—18 such that each insulator 16 forms a terminus for each corresponding radiating element 18. A balun transformer 26 is interposed in the antenna 12 and electrically communicates between the two radiating elements 18—18 such that the transmission line 14 couples to and communicates with the radiating elements 18—18 through the balun transformer 26. The antenna 12 is resonant on or about 3.5 Megahertz (i.e. the 80 meter band). As shown in the graphs of standing wave ratio for the Windom antenna 12 in FIG. 6, the antenna 12 is harmonically resonant near the 40, 20, 17, 12, and 10 meter bands (i.e. the antenna 12 is capable of resonating near frequencies that are multiples of the fundamental frequency) such that the antenna is considered usable, and is capable of transmitting and/or receiving radio waves in those harmonically resonant bands. However, as further shown in FIG. 6 in the graphs where no curve is plotted (i.e., 160, 75, 30, and 15 meter bands), the standing wave ratio is much too high for transmitting with a modern solid state transmitter or transceiver, which renders the antenna 12 useless for transmitting radio waves on those frequencies. It is understood that, although antenna tuning devices may be used to compensate for poor usability in those ranges, such antenna tuning devices are expensive and require readjustment as the operating frequency is shifted slightly. It is generally understood by those skilled in the art that a standing wave ratio (i.e. "SWR") approaching 1:1 is preferred and that a ratio of about 1.5:1 or less is deemed usable without the aforementioned antenna tuning devices. Additionally, it is generally understood that a ratio exceeding 2:1 is generally considered unusable for modern transmitters and/or transceivers, unless one of the aforementioned matching devices is utilized, as the impedance mismatch between the antenna 12 and the transmitter and/or transceiver (not shown) risks damage to the transmitter/transceiver, and causes heating, and attendant loss of radiated power.

One preferred embodiment of the improved broadband antenna 10 of the invention is represented in the diagram shown in FIG. 2. The embodiment of FIG. 2 comprises a dipole assembly 20 having pair of opposed radiating elements 22–24 which are coupled to the feedline at the excitation point or connection point (i.e., the balanced to unbalanced transformer or balun transformer 26). It is understood that baluns or balun transformers, such as balun transformer 26, are well-known and readily available on the commercial market. One vendor of such baluns 26 is Palamar Industries of Escondido, Calif. It is further understood by those skilled in the art that a balance to unbalance transformer (i.e., balun transformer 26) is unnecessary when a feed line/transceiver combination has an impedance which matches the impedance of the antenna 10. A pair of end insulators 28–30 respectively terminate the ends of the radiating elements 22–24, and for the embodiment of FIG. 2, two trap circuits, generally illustrated as 31, are intercoupled between the balun transformer 26 and the respective insulators 28–30 along the respective radiating elements 22–24. Generally, the radiating element 22 comprises a total length of about 2.0 times the length of the radiating element 24. More specifically, the radiating element 22 comprises an inner line 42 and an outer line 40 which are interconnected or communicate through a trap 32 (i.e., trap 31), such that the radiating element 22 comprises the insulator 28, the outer line 40, the trap 32 and the inner line 42. The outer line 40 forms electrical connections or couplings 48–50 such that the connection or coupling 48 is electrically connected with or communicates with trap 32, and the other coupling 50 is connected with or secured to the insulator 28. Similarly, the inner line 42 forms electrical connections 44–46 such that connection 44 interconnects the balun transformer 26 and the inner line 42 to enable electrical communication therewith, and the connection 46 interconnects a trap 32 (e.g. trap 31) and the inner line 42 such that electrical communication therebetween is achieved. The radiating element 24 likewise comprises an inner line 38 (see FIG. 2) and an outer line 36 which are interconnected or communicate through a trap 34 (i.e. trap 31), such that the radiating element 24 comprises the insulator 30, the outer line 36, the trap 34 and the inner line 38. The outer line 36 forms electrical connections or couplings 56–58 such that the connection or coupling 56 is electrically connected with or communicates with trap 34 (e.g. trap 31), and the other coupling 58 is connected with or secured to the insulator 30. Similarly the inner line 38 forms electrical connections 52–54 such that connection 52 interconnects the balun transformer 26 and the inner line 38 to enable electrical communication therewith, and the connection 54 interconnects the trap 34 and insulator the inner line 38 such that electrical communication therebetween is achieved.

In a preferred embodiment of the antenna of FIG. 2, the length of the outer line 40 of radiating element 22 ranges from about 11.40 feet to about 12.60 feet, more preferably from about 11.90 feet to about 12.10 feet, most preferably about 12 feet. The inner line 42 of the radiating element 22 ranges from about 75 feet to about 82 feet in length, more preferably from about 77.0 feet to about 80.0 feet in length, most preferably about 78.5 feet in length. Correspondingly, the inner line 38 of radiating element 24 ranges in length from about 37.0 feet to about 41 feet, more preferably from about 38.5 feet to about 39.4 feet, most preferably about 39.0 feet. The outer line 36 of radiating element 24 ranges from about 5.7 feet to about 6.3 feet in length, more preferably from about 5.9 feet to about 6.1 feet in length, most preferably about 6.0 feet in length.

The balun transformer 26 which interconnects the radiating element 24 and the radiating element 22 preferably has an impedance ratio suitable for matching the antenna 10 to the transmission line 14 and to the radio transceiver, frequency generator, or the like. For the embodiment of FIG. 2, the balun transformer 26 has an impedance ratio of about 6:1 for matching the transmission line 14 having an impedance of about 50 ohms to the improved antenna 10 of FIG. 2, which has an impedance of about 300 ohms. It is understood however, that the balun transformer 26 may be eliminated if transmission line of about 300 ohms and a transmitter (not shown) output impedance of about 300 ohms are used with the embodiment of the improved antenna 10 of the present invention shown in FIG. 2.

Figure 12:
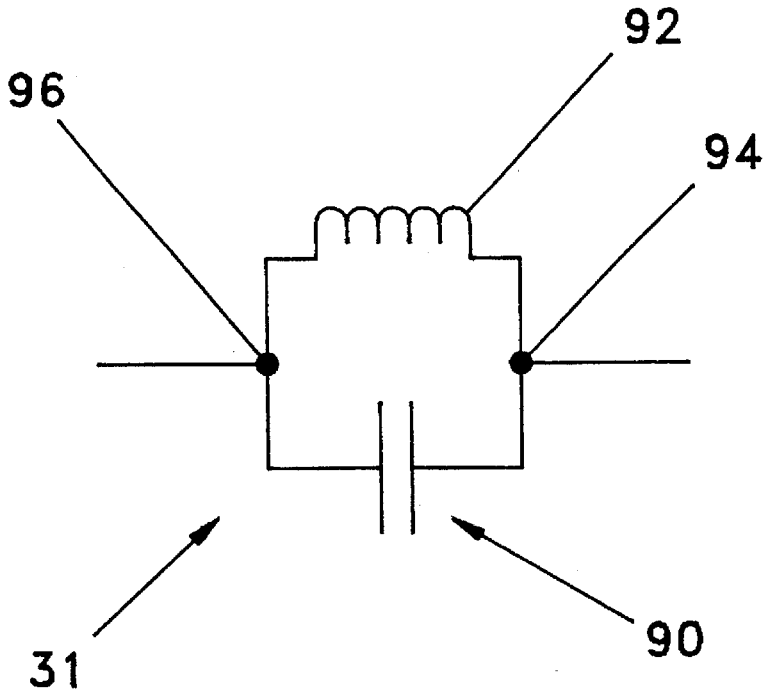
FIG. 12 is a circuit diagram of a parallel resonant circuit (i.e. a trap).

Traps 31 (e.g. traps 32 and 34) are commonly known to those artisans skilled in the construction of antennas as having a typical configuration as shown in FIG. 12 wherein a capacitor 90 and an inductor 92 wired in parallel to form two electrical ends 94–96 which are common to opposed electrical ends of the capacitor 90 and the inductor 92. It is known that to vary the values of the capacitor 90 and/or the inductor 92 will determine a frequency of the trap 31 (e.g. traps 32 and 34) and that the trap 31 operates to terminate the electrical length of an antenna (i.e. antenna 10) at this frequency. For the specific embodiment in FIG. 2, the particular values of the capacitor 90 (hereinafter referred to as "C", measured in picofarads or "pF") and the inductor 92 (hereinafter referred to as "L", measured in microhenries or "uH") of the trap 31 are not critical for the antenna to function according to the invention, as long as the combined values of L and C (i.e. pF and uH) cause resonance at the desired frequency, as will be discussed in the following; however, it will be seen that in other preferred embodiments, the values of L and C (i.e. pF and uH) are important in the proper function of the trap 31 employed and preferred ranges of L and C will accordingly be given. The traps 32 and 34 (i.e. traps 31) of the dipole assembly 20 of FIG. 2 are each tuned to a frequency preferably ranging from about 3.3 megahertz to about 3.8 megahertz, more preferably ranging from about 3.45 megahertz to about 3.55 megahertz, most preferably about 3.5 megahertz. It is understood that the traps 32 and 34 may be "moved" along the respective radiating elements 22–24 (i.e. increasing or decreasing the ratio of the lengths of the respective inner lines 42–38 to their corresponding outer lines 40–36) to fine tune the dipole assembly 20.

Another embodiment of the improved broadband antenna 10 is shown in FIG. 3 and is similar to that of FIG. 2 with the omission of trap 32 from the radiating element 22, and different physical and electrical lengths of the radiating elements 22–24, which will be discussed as this description proceeds. As shown in FIG. 3, the radiating element 22 comprises one line 21 which communicates with the balun transformer 26 at one end and terminates in insulator member 20 at the other end. More specifically, the embodiment of the antenna 10 shown in FIG. 3 comprises an off-center fed dipole assembly, generally illustrated as 62. The dipole assembly 62 comprises the radiating elements 22–24 having ends coupled to or communicating with the balun transformer 26 and respective opposed ends secured to or coupled to the terminating members 28–30. More specifically further, the radiating element 22 (i.e. line 21) comprises the connection or coupling 50 terminating or securing one end of the radiating element 22 to the terminating member 28, and the coupling 44 for electrically connecting the other end of the radiating element 22 to the balun transformer 26. Similarly, as previously mentioned, the radiating element 24 comprises the inner line 38 and the outer line 36 which are in electrical communication through the trap 34 (e.g. trap 31), such that the radiating element 24 comprises the insulator 30, the outer line 36, the trap 34 and the inner line 38. As further previously indicated, the outer line 36 forms the electrical connections or couplings 56–58 such that the connection or coupling 56 electrically connects with or allows for electrical communication between the trap 34 (e.g. trap 31) and the outer line 36, while the other coupling 58 connects and secures the insulator 30 to the outer line 36. Similarly, the inner line 38 forms electrical connections 52–54 such that connection 52 interconnects the balun transformer 26 and the inner line 38 to enable electrical communication therewith, and the connection 54 interconnects the trap 34 and the inner line 38 such that electrical communication therebetween is achieved. It can be seen that the construction of the radiating element 24 for this embodiment is similar to the construction of the radiating element of FIG. 2, although, as previously noted, the electrical and/or physical lengths are different, as are the trap resonance values, as will be discussed.

In a preferred embodiment of the dipole antenna 10 of FIG. 3, the length of the radiating element 21 ranges from about 85.0 feet to about 95.0 feet, more preferably from about 89.3 feet to about 91.1 feet, most preferably about 90.25 feet. The inner line 38 of radiating element 24 ranges in length from about 24.0 feet to about 26.6 feet, more preferably from about 25.0 feet to about 25.5 feet, most preferably about 25.3 feet. The outer line 36 of radiating element 24 ranges from about 20.8 feet to about 23.0 feet in length, more preferably from about 21.7 feet to about 22.1 feet in length, most preferably about 21.9 feet in length. The balun transformer 26 which interconnects the radiating element 24 and the radiating element 22, as previously mentioned, preferably has an impedance ratio suitable for matching the antenna 10 to the transmission line 14 and to the radio transceiver, frequency generator, or the like. For the embodiment of FIG. 3, the balun transformer 26 has an impedance ratio of about 6:1 for matching the transmission line 14 having an impedance of about 50 ohms to the improved antenna 10 of FIG. 3, which has an impedance of about 300 ohms. It is understood however, that the balun transformer 26 may be eliminated if a transmission line and a transmitter output impedance of about 300 ohms is used with the embodiment of the improved antenna 10 of the present invention shown in FIG. 3.

As indicated previously, trap 31 (e.g. traps 32 and 34) is commonly known to those artisans skilled in the construction of antennas as having in a typical configuration as shown in FIG. 12 wherein a capacitor 90 and an inductor 92 are wired in parallel to form two electrical ends 94–96 which are common to opposed electrical ends of the capacitor 90 and the inductor 92. It is known that varying the values of the capacitor 90 and/or the inductor 92 will determine a resonant frequency function in the trap 31 (e.g. trap 34) and that the trap operates to electrically lengthen or shorten the [circuit] antenna 10 at frequencies below and above resonance respectively. For the embodiment in FIG. 3, the value of the capacitor 90 (i.e. "C") of the trap 34 preferably ranges from about 93.1 picofarads to about 94.9 picofarads, more preferably from about 93.5 picofarads to about 94.4 picofarads, most preferably about 94.0 picofarads. The value of the inductor 92 (i.e. "L")of the trap 34 in the embodiment of FIG. 3 ranges from about 50.5 uH to about 51.5 uH, more preferably from about 50.8 uH to about 51.3 uH, most preferably about 51.0 uH. More preferably however, the capacitor 90 and inductor 92 of the trap 31 (i.e. trap 34 in FIG. 3) are selected with such tolerance so as to give the frequency function according to the formula $F=\frac{1}{2}\pi\sqrt{L.C}$ and such that the frequency of the trap 34 falls within the preferred ranges following. The trap 34 of the dipole assembly 62 of FIG. 3 is tuned to a frequency preferably ranging from about 2.19 megahertz to about 2.42 megahertz, more preferably ranging from about 2.28 megahertz to about 2.30 megahertz, most preferably about 2.31 megahertz. It is understood that the trap 34 may be "moved" along the radiating element 24 (i.e. increasing or decreasing the ratio of the length of the inner line 38 to the outer line 36), or the value of the trap 34 components (i.e. the inductor 92 and/or the capacitor 90) may be increased or decreased to fine tune the dipole assembly 62, especially for the 160 meter band.

Alternative embodiments of the improved antenna 10 of the present invention are shown in FIGS. 4 and 5. The embodiments shown in FIGS. 4 and 5 are constructed in a fashion similar to the previous embodiments, and as indicated for the embodiments of FIGS. 2 and 3, the electrical and physical parameters (i.e. resonance values of the traps 31 and/or the length of the inner lines 42–38 and the outer lines 40–36) of the radiating elements 22–24 are different. The embodiments of FIGS. 4 and 5 are further modified by the addition of a spur radiator (identified as 70 below). The discussion of each of the alternative embodiments of FIGS. 4 and 5 follows.

One preferred embodiment of the improved broadband antenna assembly 63 of the present invention shown in FIG. 4 comprises the radiating elements 22–24 having the insulators 28–30 secured to or communicating with respective opposed ends of the radiating elements 22–24, and having the radiating elements 22–24 in electrical communication with the balun transformer 26. A spur radiating element 70 is capacitively coupled to connection 52 at the balun transformer 26 such that the radiating element 24, the spur radiating element 70 and the balun transformer 26 are all in common electrical communication (i.e. connection 52 connects the radiating element 24, the spur radiating element 70, and the balun transformer 26 at one common point). The spur element 70 comprises a capacitor 72 having ends 74–76 respectively electrically connected with or communicating with the balun transformer 26 at connection 52, and one end of an electrical line 78. Line 78 has end connection 82 terminating in or securing to insulator 80. As in the previous embodiments, the radiating element 22 comprises the connection or coupling 50 terminating or securing the end of the radiating element 22 to the terminating member 28, the coupling 44 for electrically connecting the other end of the radiating element 22 to the balun transformer 26, and has the inner line 42 and the outer line 40 interconnected or communicating through the trap 32 (e.g. trap 31). Thus, the radiating element 22 comprises the insulator 28, the outer line 40, the trap 32 and the inner line 42. The outer line 40 forms the electrical connections or couplings 48–50 such that the connection or coupling 48 is electrically connected with or communicates with the trap 32, and the other coupling 50 is connected with or secured to the insulator 28, and the inner line 42 forms the electrical connections 44–46 such that connection 44 interconnects the balun transformer 26 and the inner line 42, and the connection 46 interconnects the trap 32 (e.g. trap 31) and the inner line 42. Likewise the radiating element 24 comprises the inner line 38 and the outer line 36 which electrically communicate through the trap 34 (e.g. trap 31), such that the radiating element 24 comprises the insulator 30, the outer line 36, the trap 34 and the inner line 38. As further previously indicated, the outer line 36 forms the electrical connections or couplings 56–58 such that the connection or coupling 56 electrically connects with the trap 34 (e.g. trap 31) and the outer line 36, while the other coupling 58 connects or secures the insulator 30 to the outer line 36. Similarly, the inner line 38 forms electrical connections 52–54 such that connection 52 interconnects the balun transformer 26 and the inner line 38, and the connection 54 interconnects the trap 34 and the inner line 38.

A preferred embodiment of the improved antenna 10 of the present invention constructed according to the diagram in FIG. 4 preferably has a length of the outer line 40 of radiating element 22 ranging from about 3.40 feet to about 3.76 feet, more preferably from about 3.55 feet to about 3.62 feet, most preferably about 3.58 feet. The inner line 42 of the radiating element 22 ranges from about 82 feet to about 90.6 feet in length, more preferably from about 85.5 feet to about 87.2 feet in length, most preferably about 86.3 feet in length. The inner line 38 of radiating element 24 ranges in length from about 23.2 feet to about 25.6 feet, more preferably from about 24.1 feet to about 24.6 feet, most preferably about 24.4 feet. The outer line 36 of radiating element 24 ranges from about 20.8 feet to about 23.0 feet in length, more preferably from about 21.7 feet to about 22.1 feet in length, most preferably about 21.9 feet in length. The balun transformer 26 which interconnects the radiating element 24 and the radiating element 22, as previously mentioned, preferably has an impedance ratio suitable for matching the antenna 10 to the transmission line 14 and to the radio transceiver, frequency generator, or the like. For one embodiment of FIG. 4, the balun transformer 26 has an impedance ratio of about 6:1 for matching the transmission line 14 having an impedance of about 50 ohms to one of the improved antennas 10 of FIG. 4, which has an impedance of about 300 ohms. It is understood however, that the balun transformer 26 may be eliminated if a transmission line and a transmitter output impedance of about 300 ohms is used with the embodiment of the one improved antenna 10 of the present invention shown in FIG. 4. It can thus be seen that one preferred embodiment of the antenna of FIG. 4 has an impedance of about 300 ohms.

As indicated previously, traps 31 (e.g. traps 32 and 34) are commonly known to those artisans skilled in the construction of antennas as having in a typical configuration as shown in FIG. 12 wherein a capacitor 90 and an inductor 92 are wired in parallel to form two electrical ends 94–96 which are common to opposed electrical ends of the capacitor 90 and the inductor 92. It is known that varying the values of the capacitor 90 and/or the inductor 92 will determine a resonant frequency function in the traps 31 (e.g. traps 32 and 34) and that the traps 31 operate to electrically lengthen or shorten the antenna 10 at frequencies below and above resonance respectively. For one embodiment in FIG. 4, the value of the capacitor 90 (i.e. "C") of the trap 34 preferably ranges from about 93.1 picofarads to about 94.9 picofarads, more preferably from about 93.5 picofarads to about 94.4 picofarads, most preferably about 94.0 picofarads. The value of the inductor 92 (i.e. "L") of the trap 34 in one embodiment of FIG. 4 ranges from about 50.5 uH to about 51.5 uH, more preferably from about 50.8 uH to about 51.3 uH , most preferably about 51.0 uH. More preferably however, the capacitor 90 and inductor 92 of the trap 31 (i.e. trap 34 in FIG. 4) are selected with such tolerance so as to give the frequency function according to the formula $F=\frac{1}{2\pi}\sqrt{L.C}$ and such that the frequency of the trap 34 falls within the preferred ranges following. For the embodiment in FIG. 4, the value of the capacitor 90 (i.e. "C") of the trap 32 preferably ranges from about 49.5 picofarads to about 50.5 picofarads, more preferably from about 49.8 picofarads to about 50.3 picofarads, most preferably about 50.0 picofarads. The value of the inductor 92 (i.e. "L")of the trap 32 in the embodiment of FIG. 4 ranges from about 1.17 uH to about 1.29 uH, more preferably from about 1.22 uH to about 1.24 uH, most preferably about 1.23 uH. More preferably however, the capacitor 90 and inductor 92 of the trap 31 (i.e. trap 32 in FIG. 4) are selected with such tolerance so as to give the frequency function according to the formula $F=\frac{1}{2\pi}\sqrt{L\,C}$, or such that the frequency of the trap 32 falls within the preferred ranges following. The trap 32 of the dipole assembly 63 of FIG. 4 is tuned to a frequency preferably ranging from about 19.2 megahertz to about 21.3 megahertz, more preferably ranging from about 20.1 megahertz to about 20.5 megahertz, most preferably about 20.3 megahertz, and the trap 34 of the dipole assembly 63 of FIG. 4 is tuned to a frequency preferably ranging from about 2.19 megahertz to about 2.43 megahertz, more preferably ranging from about 2.29 megahertz to about 2.33 megahertz, most preferably about 2.31 megahertz. As previously indicated for the embodiments of FIGS. 2 and 3, it is understood that the traps 32–34 may be "moved" along the respective radiating elements 22–24 (i.e. increasing or decreasing the ratio of the lengths of the respective inner lines 42–38 to the corresponding outer lines 40–36), or their frequencies increased or decreased slightly to fine tune the dipole assembly 63, especially for the 15 meter and the 160 meter bands. The line 78 of the spur radiating element 70 has a length preferably ranging from about 11.6 feet to about 12.8 feet, more preferably ranging from about 12.1 feet to about 12.3 feet, most preferably about 12.2 feet. The capacitor 72 interconnecting the spur radiating element 70 to the balun transformer 26 and the radiating element 24 has a value preferably ranging from about 30.4 picofarads to about 33.6 picofarads, more preferably ranging from about 31.7 picofarads to about 32.3 picofarads, most preferably about 32 picofarads.

Another preferred embodiment of the dipole assembly 63 indicated in FIG. 4, has the overall lengths of the radiating elements 22–24 shortened and the frequency values of the traps 32–34 correspondingly increased. The length of the outer line 40 of radiating element 22 ranges from about 3.4 feet to about 3.76 feet, more preferably from about 3.55 feet to about 3.62 feet, most preferably about 3.58 feet. The inner line 42 of the radiating element 22 ranges from about 38.0 feet to about 42.0 feet in length, more preferably from about 39.6 feet to about 40.4 feet in length, most preferably about 40.0 feet in length. The inner line 38 of radiating element 24 ranges in length from about 11.6 feet to about 12.8 feet, more preferably from about 12.2 feet to about 12.5 feet, most preferably about 12.3 feet. The outer line 36 of radiating element 24 ranges from about 13.6 feet to about 15.3 feet in length, more preferably from about 14.4 feet to about 14.7 feet in length, most preferably about 14.6 feet in length. The balun transformer 26 which interconnects the radiating element 24 and the radiating element 22, as previously mentioned, preferably has an impedance ratio suitable for matching the antenna 10 to the transmission line 14 and to the radio transceiver, frequency generator, or the like. For one embodiment of FIG. 4, the balun transformer 26 has an impedance ratio of about 4:1 for matching the transmission line 14 having an impedance of about 50 ohms to one of the improved antennas 10 of FIG. 4, which has an impedance of about 200 ohms. It is understood however, that the balun transformer 26 may be eliminated if a transmission line and a transmitter output impedance of about 200 ohms is used with the embodiment of the one improved antenna 10 of the present invention shown in FIG. 4.

As indicated previously, traps 31 (e.g. traps 32 and 34) are commonly known to those artisans skilled in the construction of antennas as having in a typical configuration as shown in FIG. 12 wherein a capacitor 90 and an inductor 92 are wired in parallel to form two electrical ends 94–96 which are common to opposed electrical ends of the capacitor 90 and the inductor 92. It is known that varying the values of the capacitor 90 and/or the inductor 92 will determine a resonant frequency function in the traps 31 (e.g. traps 32 and 34) and that the traps operate to electrically lengthen or shorten the antenna 10 at frequencies below and above resonance respectively, or terminate the antenna 10 near resonance. For one embodiment in FIG. 4, the value of the capacitor 90 (i.e. "C") of the trap 34 preferably ranges from about 55.4 picofarads to about 56.6 picofarads, more preferably from about 55.7 picofarads to about 56.3 picofarads, most preferably about 56.0 picofarads. The value of the inductor 92 (i.e. "L") of the trap 34 in one embodiment of FIG. 4 ranges from about 19.8 uH to about 20.2 uH, more preferably from about 19.9 uH to about 20.1 uH, most preferably about 20.0 uH. More preferably however, the capacitor 90 and inductor 92 of the trap 31 (i.e. trap 34 in FIG. 4) are selected with such tolerance so as to give the frequency function according to the formula $F=\frac{1}{2\pi\sqrt{LC}}$ and such that the frequency of the trap 34 falls within the preferred ranges following. For the embodiment in FIG. 4, the value of the capacitor 90 (i.e. "C") of the trap 32 preferably ranges from about 19.8 picofarads to about 20.2 picofarads, more preferably from about 19.9 picofarads to about 20.1 picofarads, most preferably about 20.0 picofarads. The value of the inductor 92 (i.e. "L")of the trap 32 in the embodiment of FIG. 4 ranges from about 2.48 uH to about 2.53 uH, more preferably from about 2.49 uH to about 2.51 uH, most preferably about 2.50 uH. More preferably however, the capacitor 90 and inductor 92 of the trap 31 (i.e. trap 32 in FIG. 4) are selected with such tolerance so as to give the frequency function according to the formula $F=\frac{1}{2\pi\sqrt{LC}}$, or such that the frequency of the trap 32 falls within the preferred ranges following. The trap 32 of the dipole assembly 63 of FIG. 4 is tuned to a frequency preferably ranging from about 21.4 megahertz to about 23.6 megahertz, more preferably ranging from about 22.3 megahertz to about 22.7 megahertz, most preferably about 22.5 megahertz. The trap 34 of the dipole assembly 63 of FIG. 4 is tuned to a frequency preferably ranging from about 4.54 megahertz to about 5.02 megahertz, more preferably ranging from about 4.73 megahertz to about 4.83 megahertz, most preferably about 4.78 megahertz. As previously indicated, it is understood that the traps 32–34 may be "moved" along the respective radiating elements 22–24 (i.e. increasing or decreasing the ratio of the lengths of the respective inner lines 42–38 to the corresponding outer lines 40–36), or altered slightly in frequency to fine tune the dipole assembly 20, especially for the 15 meter and 80/75 meter bands. The line 78 of the spur radiating element 70 has a length preferably ranging from about 10.6 feet to about 11.7 feet, more preferably ranging from about 11.1 feet to about 11.3 feet, most preferably about 11.2 feet. The capacitor 72 interconnecting the spur radiating element 70 to the balun transformer 26 and the radiating element 24 has a value preferably ranging from about 30.4 picofarads to about 33.6 picofarads, more preferably ranging from about 31.7 picofarads to about 32.3 picofarads, most preferably about 32 picofarads.

A preferred embodiment of the antenna assembly 64 of FIG. 5, comprises the radiating elements 22–24 having the insulators 28–30 secured to respective ends of the radiating elements 22–24. The radiating elements 22–24 are in electrical communication with the balun transformer 26, along with the spur radiating element 70 which is capacitively coupled to connection 52 at the balun transformer 26. The spur element 70 comprises the capacitor 72 having ends 74–76 respectively electrically connected with or communicating with the balun transformer 26 at connection 52, and one end of the electrical line 78. The line 78 has end connection 82 terminating in or securing to the insulator 80. As in the previous embodiments, the radiating element 22 comprises the connection or coupling 50 terminating or securing the end of the radiating element 22 to the terminating member 28, the coupling 44 for electrically connecting the other end of the radiating element 22 to the balun transformer 26, and has the inner line 42 and the outer line 40 interconnected or communicating through the trap 32 (e.g. trap 31). Thus, the radiating element 22 comprises the insulator 28, the outer line 40, the trap 32 and the inner line 42. The outer line 40 forms the electrical connections or couplings 48–50 such that the connection or coupling 48 is electrically connected with or communicates with the trap 32, and the other coupling 50 is connected with or secured to the insulator 28, and the inner line 42 forms the electrical connections 44–46 such that connection 44 interconnects the balun transformer 26 and the inner line 42, and the connection 46 interconnects the trap 32 (e.g. trap 31) and the inner line 42. The radiating element 24 in this embodiment comprises the inner line 38 and the outer line 36 which electrically communicate through a capacitor 86 such that the radiating element 24 comprises the insulator 30, the outer line 36, the capacitor 86 and the inner line 38. As further previously indicated, the outer line 36 forms the electrical connections or couplings 56–58 such that the connection or coupling 56 electrically connects the capacitor 86 and the outer line 36, while the other coupling 58 connects or secures the insulator 30 to the outer line 36. Similarly, the inner line 38 forms electrical connections 52–54 such that connection 52 interconnects the balun transformer 26 and the inner line 38, and the connection 54 interconnects the capacitor 86 and the inner line 38.

A preferred embodiment of the dipole assembly 64 constructed according to the diagram in FIG. 5, has the length of the outer line 40 of radiating element 22 ranging from about 3.40 feet to about 3.80 feet, more preferably from about 3.50 feet to about 3.60 feet, most preferably about 3.58 feet. The inner line 42 of the radiating element 22 ranges from about 82.0 feet to about 90.6 feet in length, more preferably from about 85.5 feet to about 87.2 feet in length, most preferably about 86.3 feet in length. The inner line 38 of radiating element 24 ranges in length from about 23.2 feet to about 25.6 feet, more preferably from about 24.2 feet to about 24.6 feet, most preferably about 24.4 feet. The outer line 36 of radiating element 24 ranges from about 20.8 feet to about 23.0 feet in length, more preferably from about 21.7 feet to about 22.1 feet in length, most preferably about 21.9 feet in length. The balun transformer 26 which interconnects the radiating element 24 and the radiating element 22, as previously mentioned, preferably has an impedance ratio suitable for matching the antenna 10 to the transmission line 14 and to the radio transceiver, frequency generator, or the like. For one embodiment of FIG. 5 the balun transformer 26 has an impedance ratio of about 6:1 for matching the transmission line 14 having an impedance of about 50 ohms to one of the improved antennas 10 of FIG. 5, which has an impedance of about 300 ohms. It is understood however, that the balun transformer 26 may be eliminated if a transmission line and a transmitter output impedance of about 300 ohms is used and the embodiment of the one improved antenna 10 of the present invention shown in FIG. 5. As indicated previously, traps 31 (e.g. trap 32) are commonly known to those artisans skilled in the construction of antennas as having in a typical configuration as shown in FIG. 12 wherein a capacitor 90 and an inductor 92 are wired in parallel to form two electrical ends 94–96 which are common to opposed electrical ends of the capacitor 90 and the inductor 92. It is known that varying the values of the capacitor 90 and/or the inductor 92 will determine a resonant frequency function in the trap 31 (e.g. trap 32) and that the trap operates to electrically lengthen or shorten the antenna 10 at frequencies below and above resonance respectively, or terminate the antenna 10 near resonance. For one embodiment in FIG. 5, the value of the capacitor 90 (i.e. "C") of the trap 32 preferably ranges from about 49.5 picofarads to about 50.5 picofarads, more preferably from about 49.8 picofarads to about 50.3 picofarads, most preferably about 50.0 picofarads. The value of the inductor 92 (i.e. "L") of the trap 32 in one embodiment of FIG. 5 ranges from about 1.21 uH to about 1.25 uH, more preferably from about 1.22 uH to about 1.24 uH, most preferably about 1.23 uH. More preferably however, the capacitor 90 and inductor 92 of the trap 31 (i.e. trap 32 in FIG. 5) are selected with such tolerance so as to give the frequency function according to the formula $F=\frac{1}{2\pi\sqrt{LC}}$ and such that the frequency of the trap 32 falls within the preferred ranges following. The trap 32 of the dipole assembly 62 of FIG. 5 is tuned to a frequency preferably ranging from about 19.3 megahertz to about 21.3 megahertz, more preferably ranging from about 20.1 megahertz to about 20.5 megahertz, most preferably about 20.3 megahertz. The capacitor 86 of the dipole assembly 64 of FIG. 5 preferably ranges from about 60.8 picofarads to about 67.2 picofarads, more preferably ranging from about 63.4 picofarads to about 64.6 picofarads, most preferably about 64 picofarads. As previously indicated for the embodiments of FIGS. 2, 3, and 4, it is understood that the trap 32 and/or the capacitor 86 may be "moved" along the respective radiating elements 22–24 (i.e. increasing or decreasing the ratio of the lengths of the respective inner lines 42–38 to the corresponding outer lines 40–36) or altering the frequency value of the trap 32 (i.e. slightly altering the values of the capacitor 90 and/or the value of the inductor 92) or the capacitor 86 to fine tune the dipole assembly 64, especially for the 15 meter and the 80/75 meter bands. The line 78 of the spur radiating element 70 has a length preferably ranging from about 11.6 feet to about 12.8 feet, more preferably ranging from about 12.1 feet to about 12.3 feet, most preferably about 12.2 feet. The capacitor 72 interconnecting the spur radiating element 70 to the balun transformer 26 and the radiating element 24 has a value preferably ranging from about 30.4 picofarads to about 33.6 picofarads, more preferably ranging from about 31.7 picofarads to about 32.3 picofarads, most preferably about 32 picofarads.

Another preferred embodiment of the dipole assembly 64 constructed according to the diagram in FIG. 5, has the length of the outer line 40 of radiating element 22 ranging from about 3.40 feet to about 3.76 feet, more preferably from about 3.55 feet to about 3.62 feet, most preferably about 3.58 feet. The inner line 42 of the radiating element 22 ranges from about 170 feet to about 189 feet in length, more preferably from about 178 feet to about 182 feet in length, most preferably about 180 feet in length. The inner line 38 of radiating element 24 ranges in length from about 48.1 feet to about 53.1 feet, more preferably from about 50.1 feet to about 51.1 feet, most preferably about 50.6 feet. The outer line 36 of radiating element 24 ranges from about 41.5 feet to about 45.9 feet in length, more preferably from about 43.2 feet to about 44.1 feet in length, most preferably about 43.7 feet in length. The balun transformer 26 which interconnects the radiating element 24 and the radiating element 22, as previously mentioned, preferably has an impedance ratio suitable for matching the antenna 10 to the transmission line 14 and to the radio transceiver, frequency generator, or the like. For one embodiment of FIG. 5 the balun transformer 26 has an impedance ratio of about 6:1 for matching the transmission line 14 having an impedance of about 50 ohms to one of the improved antennas 10 of FIG. 5, which has an impedance of about 300 ohms. It is understood however, that the balun transformer 26 may be eliminated if a transmission line and a transmitter output impedance of about 300 ohms is used and the embodiment of the one improved antenna 10 of the present invention shown in FIG. 5.

As indicated previously, traps 31 (e.g. trap 32) are commonly known to those artisans skilled in the construction of antennas as having in a typical configuration as shown in FIG. 12 wherein a capacitor 90 and an inductor 92 are wired in parallel to form two electrical ends 94–96 which are common to opposed electrical ends of the capacitor 90 and the inductor 92. It is known that varying the values of the capacitor 90 and/or the inductor 92 will determine a resonant frequency function in the trap 31 (e.g. trap 32) and that the trap operates to electrically terminate the antenna 10 at or near this frequency. For one embodiment in FIG. 5, the value of the capacitor 90 (i.e. "C") of the trap 32 preferably ranges from about 49.5 picofarads to about 50.5 picofarads, more preferably from about 49.8 picofarads to about 50.3 picofarads, most preferably about 50.0 picofarads. The value of the inductor 92 (i.e. "L") of the trap 32 in one embodiment of FIG. 5 ranges from about 1.21 uH to about 1.25 uH, more preferably from about 1.22 uH to about 1.24 uH, most preferably about 1.23 uH. More preferably however, the capacitor 90 and inductor 92 of the trap 31 (i.e. trap 32 in FIG. 5) are selected with such tolerance so as to give the frequency function according to the formula $F=\frac{1}{2\pi\sqrt{LC}}$ and such that the frequency of the trap 32 falls within the preferred ranges following. The trap 32 of the dipole assembly 64 of FIG. 5 is tuned to a frequency preferably ranging from about 19.3 megahertz to about 21.3 megahertz, more preferably ranging from about 20.1 megahertz to about 20.5 megahertz, most preferably about 20.3 megahertz. The capacitor 86 of the dipole assembly 64 of FIG. 5 is tuned to a frequency preferably ranging from about 123.5 picofarads to about 136.5 picofarads, more preferably ranging from about 128.7 picofarads to about 131.3 picofarads, most preferably about 130.0 picofarads. As indicated previously, it is understood that the trap 32 and/or the capacitor 86 may be "moved" along the respective radiating elements 22–24 (i.e. increasing or decreasing the ratio of the lengths of the respective inner lines 42–38 to the corresponding outer lines 40–36), or the values of the trap 32 and/or capacitor 86 altered slightly to fine tune the dipole assembly 64, especially for the 15 meter and 160 meter bands. The line 78 of the spur radiating element 70 has a length preferably ranging from about 11.6 feet to about 12.8 feet, more preferably ranging from about 12.1 feet to about 12.3 feet, most preferably about 12.2 feet. The capacitor 72 interconnecting the spur radiating element 70 to the balun transformer 26 and the radiating element 24 has a value preferably ranging from about 30.4 picofarads to about 33.6 picofarads, more preferably ranging from about 31.7 picofarads to about 32.3 picofarads, most preferably about 32 picofarads.

The present invention compensates for end effect, especially at the fundamental frequency for any of the particular embodiments of the antenna 10, with the use of one or more of the traps 31 (i.e. parallel resonant circuits or traps 32–34), as previously discussed. The improved antenna 10 of the present invention depicted in FIG. 2 comprises the traps 31—31 which electrically lengthen or shorten the antenna assembly 20 for particular frequencies or frequency ranges. Similarly, the dipole assembly 62 shown in FIG. 3 comprises the trap 31 for electrically lengthening or shortening the antenna assembly 62. Likewise, the antenna assemblies 63–64 respectively depicted in FIGS. 4 and 5 each comprise the use of at least one trap 31 (i.e. trap 32) and the spur radiating element 70 (i.e. line 78 and capacitor 72) to obtain resonance, with a desired impedance at the feed point, on the 15 meter band.

Figure 6:
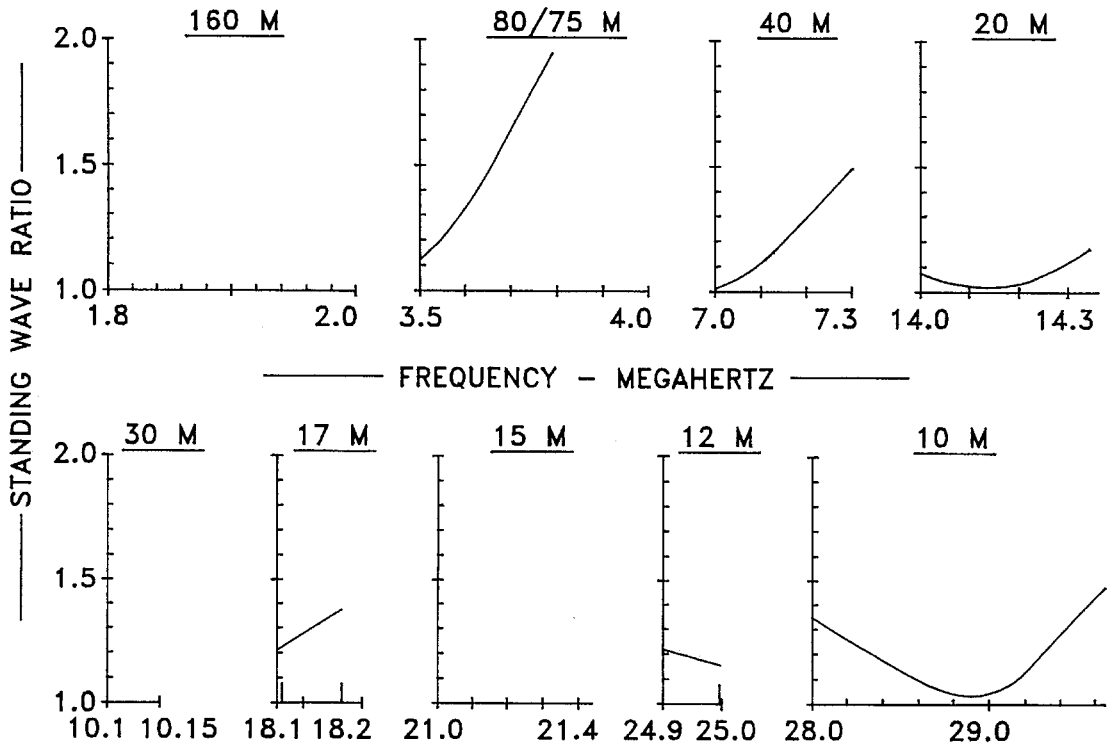
FIG. 6 is a set of graphs of standing wave ratio vs. frequency in megahertz for one embodiment of an antenna constructed according to the diagram of FIG. 1.
Figure 7:
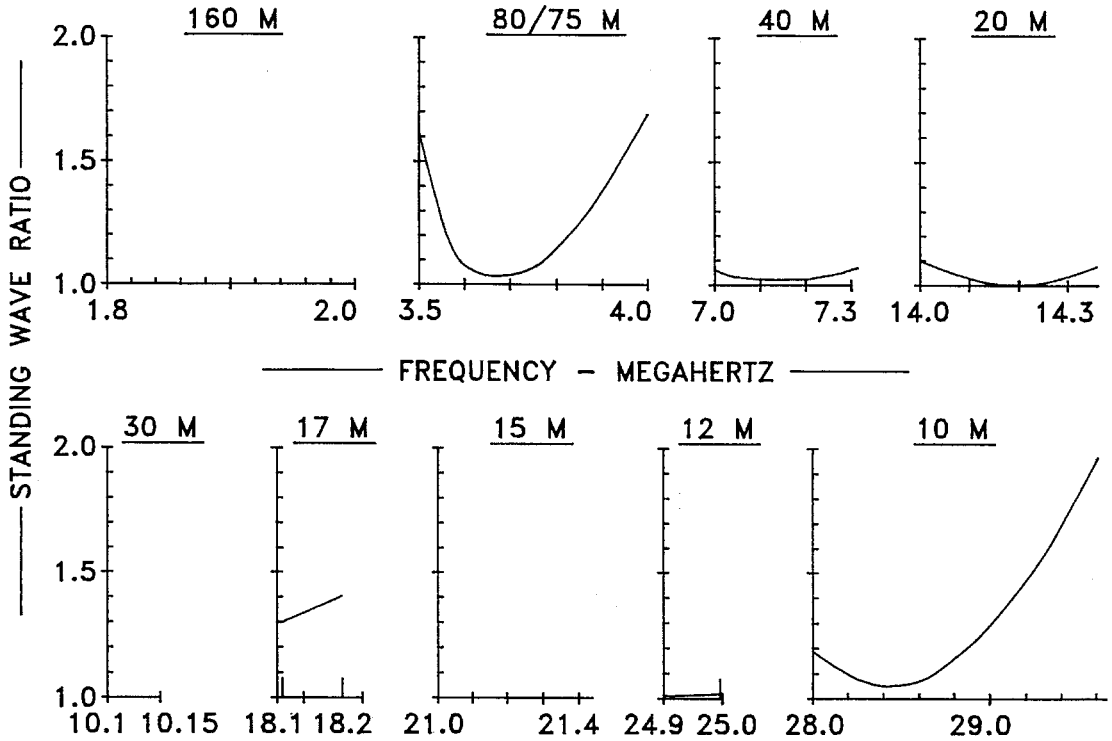
FIG. 7 is a set of graphs of standing wave ratio vs. frequency in megahertz for one embodiment of an antenna constructed according to the diagram of FIG. 2.
Figure 8:
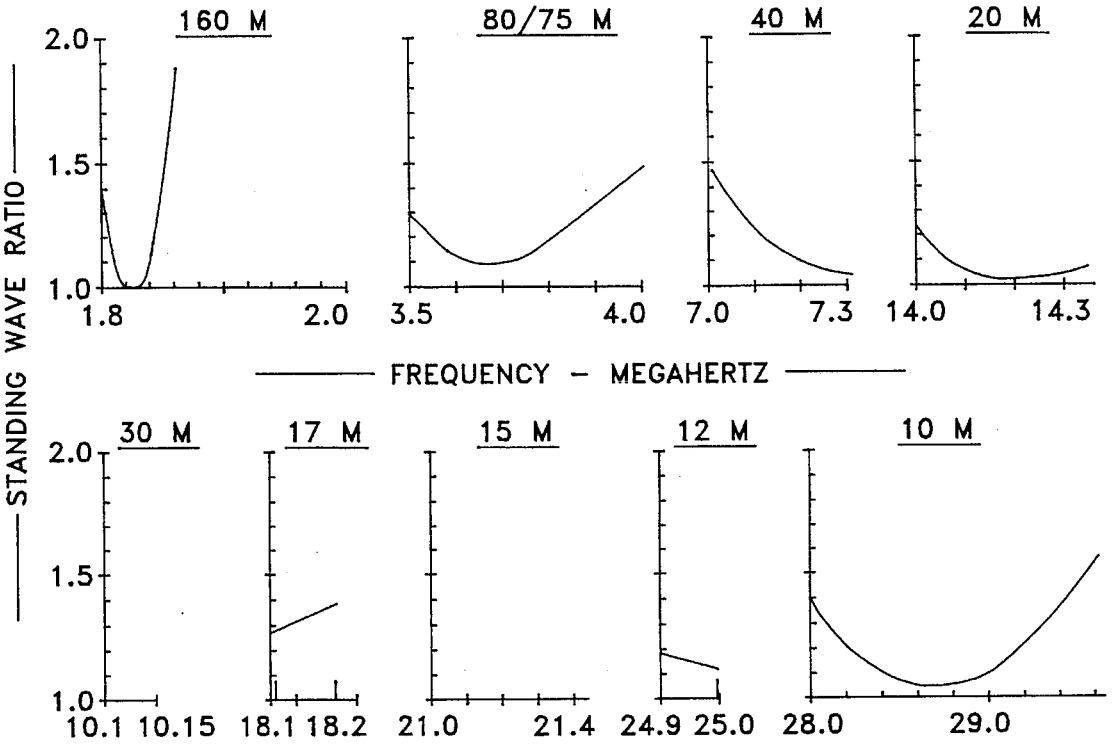
FIG. 8 is a set of graphs of standing wave ratio vs. frequency in megahertz for one embodiment of an antenna constructed according to the diagram of FIG. 3.
Figure 9:
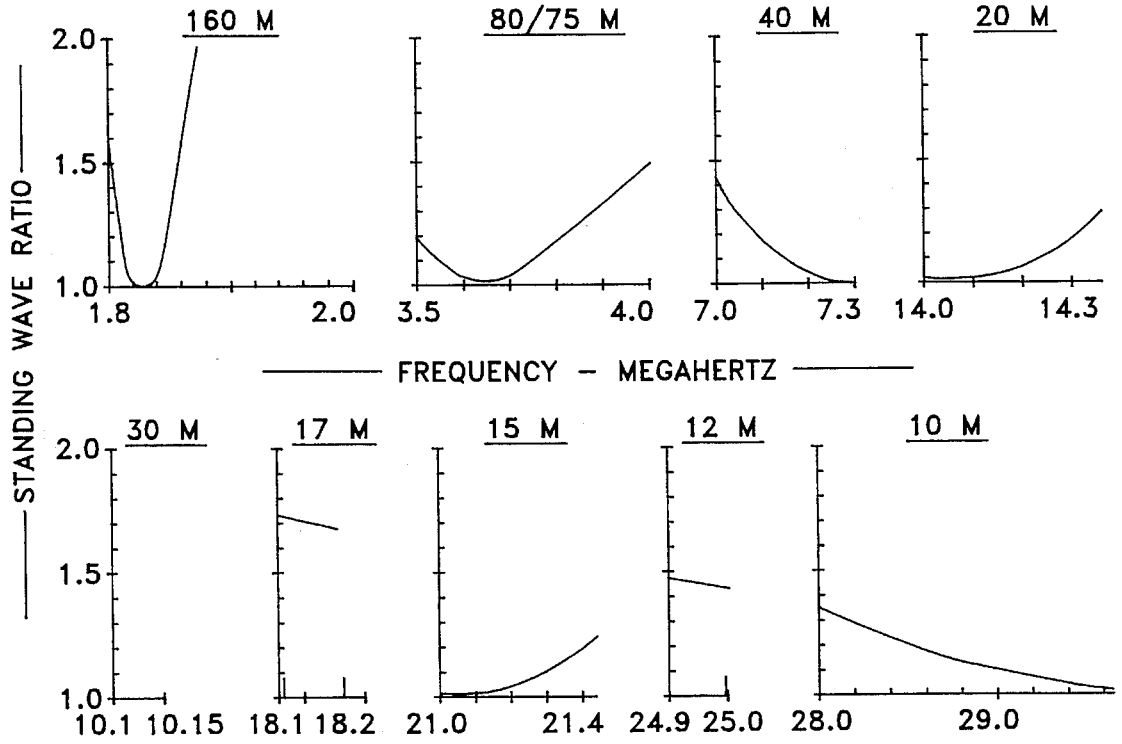
FIG. 9 is a set of graphs of standing wave ratio vs. frequency in megahertz for one embodiment of an antenna constructed according to the diagram of FIG. 4.
Figure 10:
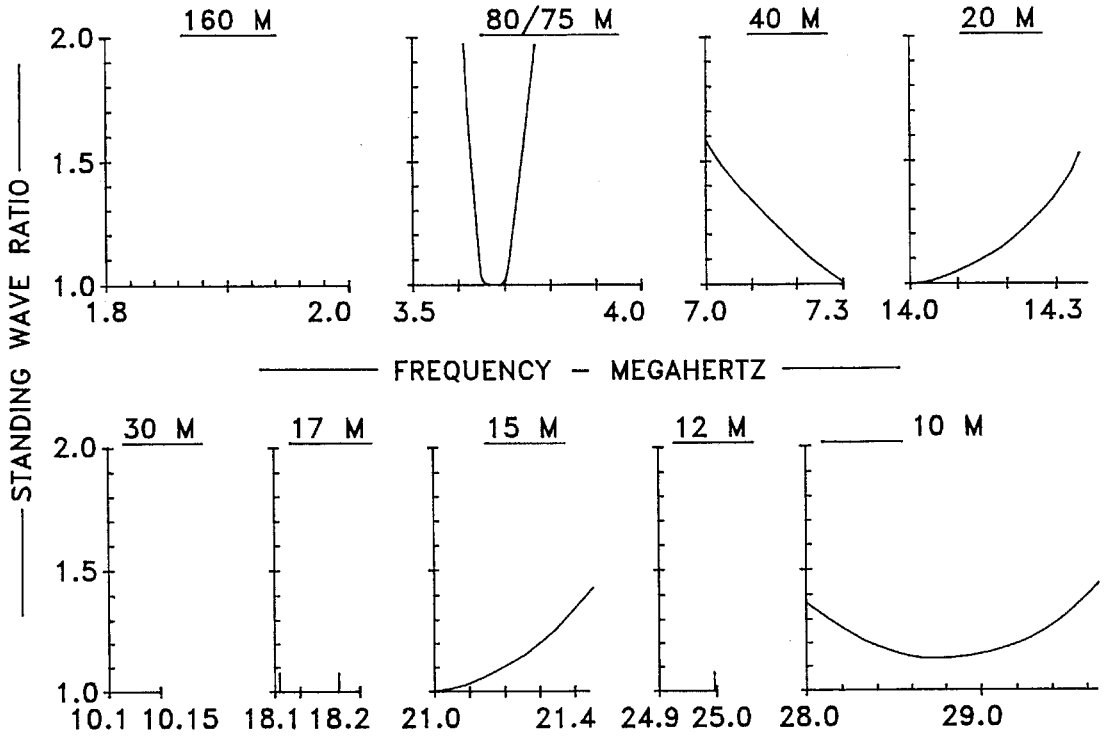
FIG. 10 is a set of graphs of standing wave ratio vs. frequency in megahertz for another embodiment of an antenna constructed according to the diagram of FIG. 4.
Figure 11:
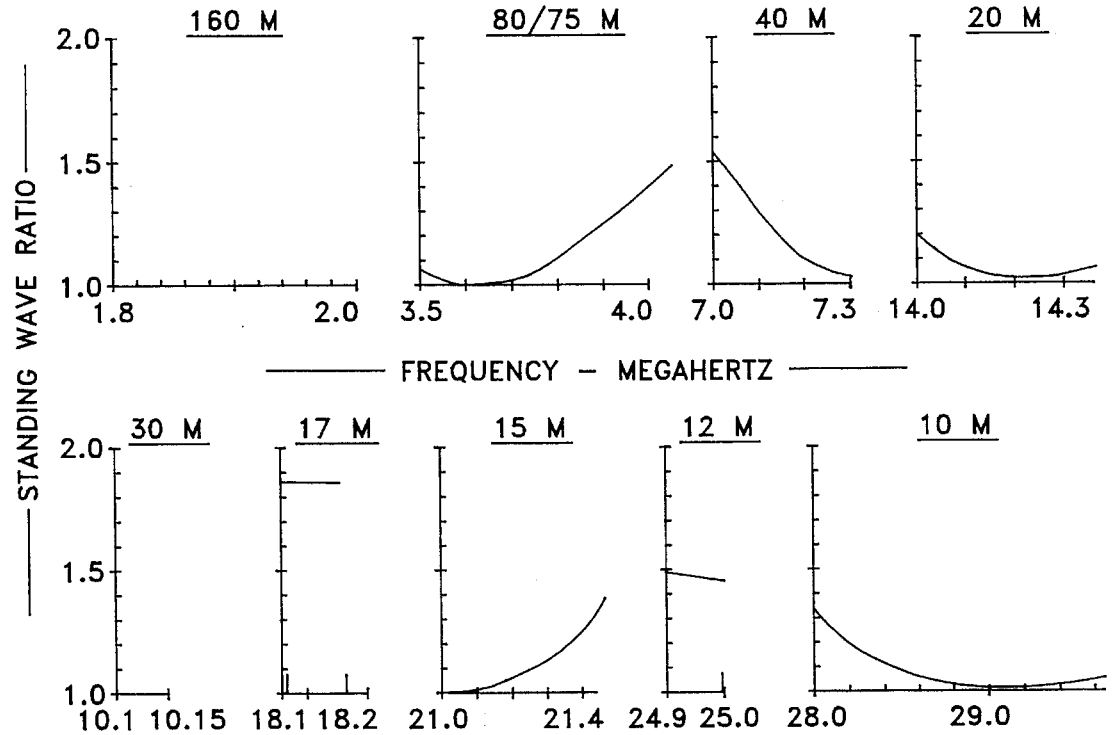
FIG. 11 is a set of graphs of standing wave ratio vs. frequency in megahertz for one embodiment of an antenna constructed according to the diagram of FIG. 5.

Tests of each of the aforementioned preferred embodiments of FIGS. 2, 3, 4, and 5 were conducted, as well as tests of the previously mentioned prior art Windom antenna, using an Icom model IC-735 HF Transceiver (produced by ICOM, Inc., Osaka, Japan). For all of the tests a 70 foot transmission line (i.e. transmission line 14) formed of RG8/U coaxial cable was used to connect the various antenna embodiments to the transceiver. The transmission line 14 was treated with twelve inches of ferrite beads placed immediately proximal to the connection at the balun transformer 26. Further, any horizontal run of transmission line 14 cable had additional ferrite beads spaced at 10 foot intervals therealong. The treatment of the transmission line 14 with ferrite beads will be recognized by those skilled in the art as necessary to reduce currents conducted or induced onto the outside of the shield of the transmission line 14, and such treatment is considered common to those skilled in the art. The soil conductivity measured for the tests was about 0.03 Siemens per meter and the antenna height was at least 25 feet, except where noted. The results of the tests are graphed in FIGS. 6–11. FIG. 6 indicates SWR results for the prior art Windom antenna of FIG. 1. FIG. 7 shows SWR results for the preferred embodiment of FIG. 2 discussed above. FIG. 7 shows that acceptable SWR results (i.e. a standing wave ratio of about 1.5:1 or less) are obtained when transmitting on frequencies in the 80/75, 40, 20, 17, 12, and 10 meter bands (i.e, respectively from 3.55 to 3.95 MHz, from 7.0 to 7.3 MHz, from 14.0 to 14.35 MHz, from 18.068 to 18.168 MHz, from 24.89 to 24.99 MHz, and from 28.0 to 29.2 MHz). FIG. 8 shows SWR results for the preferred embodiment of FIG. 3 discussed above, where acceptable results (i.e. a standing wave ratio of less than 1.5:1 for a given frequency) are indicated for a portion of the 160 meter band (i.e. from about 1.80 MHz to about 1.86 MHz), the 80/75 meter band, the 40 meter band, the 20 meter band, the 17 meter band, the 12 meter band, and most of the 10 meter band. One preferred embodiment of the improved antenna 10 of the invention indicated in FIG. 4 produced the standing wave ratio graphs of FIG. 9, where standing wave ratios of less than 1.5:1 are indicated when transmitting on frequencies in a portion of the 160 meter band (i.e. from about 1.8 MHz to about 1.86 MHz), the 80/75 meter bands, the 40 meter band, the 20 meter band, the 15 meter band, the 12 meter band, and the 10 meter band. The 17 meter band has an indicated SWR of less than 2:1. Another preferred embodiment of the antenna 10 of FIG. 4 produced the standing wave ratio graphs of FIG. 10 when transmitting on a portion of the 80/75 meter bands (i.e from about 3.6 MHz to about 3.75 MHz), the 40 meter band, the 20 meter band, the 15 meter band, and the 10 meter band. It should be noted that for the embodiment of the antenna 10 which produced the results in FIG. 10, the antenna height was at least 34 feet from the ground. SWR results from transmitting with antenna 10 of FIG. 5 over frequencies in the 80/75, 40, 20, 17, 15, 12, and 10 meter bands are indicated in FIG. 11. The graphs shown in FIGS. 7–11 indicate that the various embodiments of the improved broadband antenna 10 of the invention are capable of transmitting over a plurality of frequencies in the range of from greater than or equal to 1.8 MHz to less than or equal to 30.0 MHz.

Thus by the practice of the present invention, there is provided a method for compensating for end effect at the fundamental frequency in a Windom antenna, and a method for transmitting a radio frequency in the range of from 1.8 MHz to 30.0 MHz on the improved off-center fed dipole antenna 10 having a standing wave ratio which does not require the use of an antenna tuner. The improved antenna 10 further allows for operation on additional bands.

It is understood that the improved antennas 10 of the present invention are capable of transmitting on a fundamental frequency (e.g. 80/75 meter band/3.5–4.0 MHz) and harmonic bands thereof (e.g. 40 meter band/7.0–7.3 MHZ), and that while test results are given for radio frequencies allocated by the F.C.C. for amateur radio operation, the improved antennas 10 (i.e. dipole assemblies 62-63-64) are capable of acceptable operation (i.e. transmitting or radiating energy with a standing wave ratio of less than 1.5:1) over any suitable fundamental frequency and harmonic frequencies (e.g. harmonics and sub-harmonics) thereof.

Further, it should be understood that any number of equivalent construction techniques are understood and apparent to those artisans skilled in the art and are included in the spirit and/or scope of the present invention, such as by way of example only but not limited to, fastening members or methods, cylindrical or toroidal coils, various types of capacitors or radiating elements formed with various types of conductors.

Thus, by the further practice of the invention, there is provided the improved antenna 10 which is electrically shortened inversely with frequency due to capacitance of capacitor 90 of the parallel resonant trap 34 wired in series with the antenna 10 (as shown in FIGS. 2–4) or due to capacitance of capacitor 86 as shown in FIG. 5, for reducing end effect of the improved antenna 10 at the natural fundamental frequency. The use of the inductor 92 (e.g. inductor 92 of the parallel resonant trap 34) serves to electrically lengthen the improved antenna 10 for sub-harmonic operation of the antenna at frequencies below the natural fundamental frequency of the antenna 10. The positioning of the parallel trap 32 as shown in FIGS. 3–5 effects an alteration of the excitation point impedance for a particular band of frequencies when used with the spur radiating element 70; these frequencies (i.e., the 15 meter band) are naturally resonant with the portion of the antenna 10 (i.e. radiating element 22) that is shortened by the trap 32, and the spur radiating element 70. Simultaneously, minimal change to the excitation point impedance of other bands of frequencies is effected. As indicated previously, tests of various embodiments of the improved antenna 10 are given in FIGS. 7–11, which tests indicate that an improved standing wave ratio (i.e., a standing wave ratio of at least 1.5:1 or less) is achieved.

It is understood that in the preceding, the discussed balun transformer 26 may be replaced with commonly known construction techniques, such as an excitation point insulator for connecting the radiating elements 22–24 directly to the feedline 14.

Thus, while the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An off-center fed dipole antenna for use in the transmission and reception of radio frequency energy over a broad bandwidth while maintaining a standing wave ratio of less than 1.5:1 for frequencies in harmonic bands without requiring the use of an antenna tuning means, comprising:

a first radiating element having a pair of opposed ends and a first length having a first measurement with a first value;

a second radiating element having a pair of opposed ends and a second length having a second measurement with a second value;

an excitation point insulator electrically insulating one of said opposed ends of said first radiating element from one of said opposed ends of said second radiating element for connecting to a feedline;

a first insulator member secured to one of said opposed ends of said first radiating element;

a second insulator member secured to another of said opposed ends of said second radiating element; and a first capacitor member having a first capacitor value electrically disposed in said first radiating element such that said first radiating element comprises a first outer radiating element electrically communicating with said first insulator member and said capacitor member and a first inner radiating element electrically communicating with said connection point and said capacitor member to form an off-center fed dipole antenna for use in the transmission and reception of radio frequency energy over a broad bandwidth; said first value in combination with said second value and in combination with said first capacitor value obtaining a stand-in wave ratio of less than 1.5:1 for transmitting, without requiring the use of an antenna tuning means, over a bandwidth having a frequency in a meter band selected from the group consisting of the 80/75 meter band,the 40 meter band, the 20 meter band, the 17 meter band, the 12 meter band, and at least a portion of 10 meter band.

2. The antenna of claim 1 additionally comprising a first trap member having an inductor member wired in parallel with said capacitor; and wherein said meter band is selected from the group additionally comprising at least a portion of the 160 meter band.

3. The antenna of claim 2 wherein said excitation point insulator comprises a balun transformer member which electrically interconnects said first radiating element and said second radiating element.

4. The antenna of claim 2 additionally comprising electrically shortening inversely to frequency with a capacitor of said first trap member wired in series with said antenna for compensating end effect of said antenna at its natural fundamental frequency and harmonic and frequencies thereof; and electrically lengthening with an inductor of said first trap member for resonating at sub-harmonic frequencies thereof.

5. The antenna of claim 2 wherein said second radiating element comprises a length of from 89.8 feet to 91.0 feet; wherein said first inner radiating element comprises a length of from 25.0 feet to 25.6 feet; wherein said first outer radiating element comprises a length of from 21.6 feet to 22.2 feet; wherein said capacitor comprises a value of from 93 picofarads to 95 picofarads; wherein said inductor comprises a value of from 50.0 microhenries to 52.0 microhenries; and wherein said first trap member comprises a value of 2.20 megahertz to 2.40 megahertz.

6. The antenna of claim 1 wherein said length of said second radiating element is at least 1.5 times the length of said first radiating element.

7. A method for radiating or transmitting radio waves in a radio frequency in the range of from about 10.0 KHz to about 250 MHz, with a standing wave ratio of less than 1.5:1 with an off-center fed dipole antenna comprising the steps of:

(a) providing an improved broadband off-center fed dipole antenna capable of radiating or transmitting radio waves in a frequency selected from the group consisting of the 80/75 meter band, the 40 meter band, the 20 meter band, the 17 meter band, the 12 meter band, a portion of the 10 meter band, and a portion of the 160 meter band, said off-center fed dipole antenna having at least one trap member wired in series therewith which is adapted to maintaining a standing wave ratio of less than 1.5:1 for frequencies in harmonic bands without requiring the use of an antenna tuning means and comprising a first radiating element having a first length in communication with a connection point, a second radiating element having a second length in communication with said connection point, and a first capacitor member of said at least one trap member having a first capacitor value and electrically disposed in said first radiating element such that said first radiating element comprises a first outer radiating element and a first inner radiating element wired in series with opposite poles of said first trap member;

(b) coupling said improved antenna to a radio frequency generator transmitter capable of generating energy in a radio frequency in the range of from 10.0 Khz to 250 Mhz;

(c) generating energy in said radio frequency with said radio frequency generator and relaying said generated energy to said improved antenna;

(d) radiating said energy with said improved antenna such that an antenna current constituent of said energy passes through said trap member to alter a fundamental frequency of said improved antenna.

8. The method of claim 7 wherein said radiating step (d) additionally comprises passing said antenna current constituent through said trap member to alter harmonic resonances of said improved antenna.

9. The antenna of claim 7 wherein said second radiating element comprises a length of from 89.8 feet to 91.0 feet; wherein said first inner radiating element comprises a length of from 25.0 feet to 25.6 feet; wherein said first outer radiating element comprises a length of from 21.6 feet to 22.2 feet; wherein said capacitor value ranges from 93 picofarads to 95 picofarads; wherein said at least one trap member comprises and inductor having a value of from 50.0 microhenries to 52.0 microhenries; and wherein said at least one trap member has a value ranging from 2.20 megahertz to 2.40 megahertz.

10. An off-center fed dipole antenna for use in the transmission and reception of radio frequency energy over a broad bandwidth while maintaining a standing wave ratio of less than 1.5:1 for frequencies in harmonic bands without requiring the use of an antenna tuning means, comprising:

a first radiating element having a pair of opposed ends and a first length having a first measurement with a first value;

a second radiating element having a pair of opposed ends and a second length having a second measurement with a second value;

an excitation point insulator electrically insulating one of said opposed ends of said first radiating element from one of said opposed ends of said second radiating element for connecting to a feedline;

a first insulator member secured to one of said opposed ends of said first radiating element;

a second insulator member secured to another of said opposed ends of said second radiating element; and a first trap member having a first trap value and electrically disposed in said first radiating element such that said first radiating element comprises a first outer radiating element electrically communicating with said first insulator member and said first trap member and a first inner radiating element electrically communicating with said connection point and said first trap member;

a second trap member having a second trap value electrically disposed in said second radiating element such that said second radiating element comprises a second outer radiating element electrically communicating with said second insulator member and said second trap member and a second inner radiating element electrically communicating with said excitation point insulator and said second trap member; and a third radiating element having a third value capacitively coupled to said first inner radiating element with a capacitor member having a capacitor value for resonating in combination with said second inner radiating element wherein said third radiating element, said second inner radiating element, and said capacitor value in combination are resonant at a radio frequency within the range of about 21.0 MHz to about 21.45 MHz to form an off-center fed dipole antenna for use in the transmission and reception of radio frequency energy over a broad bandwidth; said first value in combination with said second value and in combination with said first trap value obtaining a standing wave ratio of less than 1.5:1 for transmitting, without requiring the use of an antenna tuning means, over a bandwidth having a frequency in a meter band selected from the group consisting of the 80/75 meter band,the 40 meter band, the 20 meter band, the 15 meter band, the 12 meter band, the 10 meter band and at least a portion of 160 meter band.

* * * * *